United States Patent [19]

Clarke, Jr. et al.

[11] 4,245,492

[45] Jan. 20, 1981

[54] HYDRAULIC PNEUMATIC SYNCHRONIZING SYSTEM FOR COUNTER-BLOW IMPACT FORGING HAMMERS

[75] Inventors: Eugene C. Clarke, Jr.; Charles W. Frame, both of Chambersburg, Pa.

[73] Assignee: Chambersburg Engineering Company, Chambersburg, Pa.

[21] Appl. No.: 5,350

[22] Filed: Jan. 22, 1979

[51] Int. Cl.[3] ..... B21J 7/34

[52] U.S. Cl. ..... 72/407; 72/441

[58] Field of Search ..... 72/407, 441, 443, 453.1, 72/453.08; 91/171; 100/264

[56] References Cited

U.S. PATENT DOCUMENTS

| | | | |
|---|---|---|---|
| 2,636,350 | 4/1953 | Alcorn | 91/171 |
| 2,729,943 | 1/1956 | Clarke | 91/171 |
| 2,785,535 | 3/1957 | Alcorn | 72/407 |
| 3,048,019 | 8/1962 | Clarke | 91/171 |
| 3,767,341 | 10/1973 | Siebelhoff | 91/171 |

FOREIGN PATENT DOCUMENTS

| | | | |
|---|---|---|---|
| 896003 | 11/1953 | Fed. Rep. of Germany | 72/407 |
| 1087273 | 2/1955 | France | 91/171 |

*Primary Examiner*—Leon Gilden
*Assistant Examiner*—Gene P. Crosby
*Attorney, Agent, or Firm*—John C. Dorfman

[57] ABSTRACT

A pair of hydraulic stabilizing cylinders are supported on a common frame parallel to the main pneumatic drive cylinders driving counter-blow hammer impellers. The stabilizing piston within each stabilizing cylinder is connected to its adjacent impeller. Those ends of the respective stabilizing cylinders adjacent the impeller are connected to the opposite ends of the other stabilizing cylinders by fluid filled hydraulic lines. Because the cylinders and pistons are the same size, as the impellers move, fluid is transferred from one end of each cylinder to the other end of the other. However, should the impellers not move in synchronism toward their point of impact, that impeller tending to move ahead of the other will experience resistance from the fluid in the stabilizing system which tends to keep the impellers in step. In addition, means is provided to detect differences in position of the synchronizing pistons. Any difference in the relative positions of the synchronizing pistons is used to operate the appropriate one of valve operating switches regulating feed of air from an air supply to the air cushion at the retraction end of the main pneumatic drive cylinder. The added air repositions the drive piston in the more retracted position to correct any tendancy for the impellers to start out of step.

21 Claims, 5 Drawing Figures

HYDRAULIC PNEUMATIC SYNCHRONIZING SYSTEM FOR COUNTER-BLOW IMPACT FORGING HAMMERS

This invention relates to a hydraulic pneumatic synchronizing systems for devices sometimes known as counter-blow hammers. Pneumatic forgoing apparatus of this type employ two movable rams, each of which includes an impeller carrying a die, which dies are driven together for the purpose of forgoing metal between them. Various devices of this sort known as "Impacters" have been made by Chambersburg Engineering Company of Chambersburg, Pa, assignee of the present invention.

More specifically the present invention relates to a stabilizing system for such a device. The system has pistons connected to the rams and synchronizing cylinders on the frame, which cylinders exchange incompressible fluid to enable synchronizing of the rams.

The present invention also contemplates correction of errors which may arise in the system over a period of time or intermediate periods of service. Such corrections is accomplished for a counter-blow type input forging hammer by adjustment of the pressure of the air cushion at the end remote from the impellers of one of the drive cylinders in a counter-blow type of impact forgoing hammer.

BACKGROUND OF THE INVENTION

The impellers of a counter-blow hammer are each driven by an independent air cylinder. The successful operation of the counter-blow hammer requires that the dies collide at a constant plane of impact intermediate the impellers. However, since the impellers are essentially free bodies, driven by independent air cylinders through independent pistons, controlled by independent inlet and exhaust valves, and sliding on independent ways lubricated independently, slight variations in the condition or operation of any of these structural components will tend to cause "off center" impact. The need to synchronize the impellers to assure precisely constant center of impact has been the subject of considerable study and design. Since the Impacter was first conceived, over a period of many years. Chambersburg Engineering Company has devised various ways for keeping the impellers in synchronism. An early method employed pneumatic techniques for modifying operating times for the pneumatic inlet and exhaust valves to correct errors as shown in U.S. Pat. No. 2,615,306 to Alcorn. An improved sensing means for control of such a device is shown in Alcorn U.S. Pat. No. 2,636,350. Mechanical sensing of impeller position, including differential sensing of errors in relation to impeller positions, leading to adjustments through correcting valves in the pneumatic systems of each of the raws was shown in Clarke and Weyer U.S. 2,729,943, and the modification in Clarke and Weyer U.S. Pat. No. 3,048,019. It will be noted that the techiques in each of these crases is correction directed through suitable valve means to modify the flow of supply air for driving the rams. While these systems have been effective and made the use of counter-blow hammers practical for many years, they have left room for performance improvement. Each of these prior art correction systems has also been complex, adding to the initial expense of the structure and the cost of maintenance.

SUMMARY OF THE INVENTION

The present invention relates to a hydraulic pneumatic synchronizing system. The system provides control arrangements which, when working together, provide a relatively direct correction by a simple structure and avoids much of the complexity of the prior art, while at the same time achieving even higher accuracy than has been possible in the prior art. The invention consists of two systems which are best used together but which may also be used separately in connection with other arrangements.

The hydraulic system, better described as a system employing imcompressible fluids, involves a pair of hydraulic cylinders supported on the frame and having their respective pistons connected to one of the impellers, with hydraulic interconections between opposite sides of the respective cylinders. These hydraulic interconnections allow movement of the piston quite freely as long as the impellers are in synchronism but offer resistance to an impeller which tends to move ahead of the other impeller. The incompressible fluid effectively holds back one impeller while urging the other impeller to catch up.

The pneumatic system employs a sensing means to detect an out of synchronism position, primarily in the static condition. It requires a hammer system employing an air cushion at that end of each drive cylinder remote from the impeller which lies behind the exhaust port. The pneumatic system involves additions of air pressure to the cushion of one of the cylinders to adjust its piston position to correspond with the piston position in the other cylinder so that the two impellers will start from the same initial positions. The air is added in response to a detection of position unbalance which initiates a feed of air to that cushion requiring the repositioning forward of its piston.

More specifically the present invention involves improvement to a counter-blow type of impact forging hammer. The hammers involved have a common support frame and a pair of impellers. Means are provided for supporting, driving and guiding the impellers along the predetermined aligned paths toward impact. These means include a pair of pneumatic pistons and connection means connecting each of the pistons to one of the impellers, and a pair of opposed aligned pneumatic cylinders supported on the support frame. The pneumatic cylinders have pneumatic inlet and exhaust ports positioned to permit pneumatic drive of the pistons. Pneumatic conduit means connect high pressure pneumatic supply means to an inlet port of each of the cylinders. Impact force regulating valve and control means for the respective conduit means controls the flow of the fluid into the cylinder. Control means regulate the exhaust of compressible fluid from each of the cylinders to the exhaust port to permit the piston and its associated impeller to be withdrawn from impact. In accordance with the invention, a pair of hydraulic stabilizing cylinders are supported on the support frame generally parallel to the respective pneumatic drive cylinders. Stabilizing double rod end pistons within the stabilizing cylinders provide equal areas exposed to incompressible fluid within the stabilizing cylinders on opposite sides of the piston. A mechanical connection is made between the stabilizing piston and the ram structure, preferably the impeller, and parallel to the connection between the pneumatic drive piston and the impeller. Fluid flow lines cross-connect near impeller ends of the stabilizing cylinders to opposite remote ends of the other cylinders. Incompressible fluid within and essentially filling the stabilizing cylinders and cross-connected lines will tend to resist any tendency for one piston and its connected impeller to move ahead of the other.

Each of the pneumatic drive cylinders is preferably provided with an air cushion area at the end remote from the impellers which effectively retards ram movement and offers abrupt resistance to return piston movement. This occurs when the drive piston during retraction passes over and closes off the exhaust port so that air cannot escape from the cushion area in the end of the cylinder. Thereafter, the air cushion tends to slow and reverse the movement of the piston to return the piston to a stable reset position. Should one piston enter the cushion area before the other and at a faster rate, the cushion will tend to slow it more than the slower piston and thereby equalize the effect upon the two and return them to synchronism.

Should the rams persist in non-synchronous position, having been through dynamic air cushion repositioning, sensing means is used to detect the out of balance positions and produce a differential signal. Means comparing signals representative of position is provided whereby, if the impellers are out of synchronism the unbalance in the signals is detected. The unbalance in preferred systems cause operation of valve means to connect a high pressure air supply to the cushion for predetermined time increments to add an incremental air pressure. The increased connection urges the lagging piston forward. If out of balance is still detected, further increments of air pressure can be added until balanced positions of the rams are achieved.

BRIEF DESCRIPTION OF FIGURES

For a better understanding of the present invention, reference is made to the accompanying drawings in which.

DESCRIPTION OF THE SPECIFIC EMBODIMENT

Figure 1:
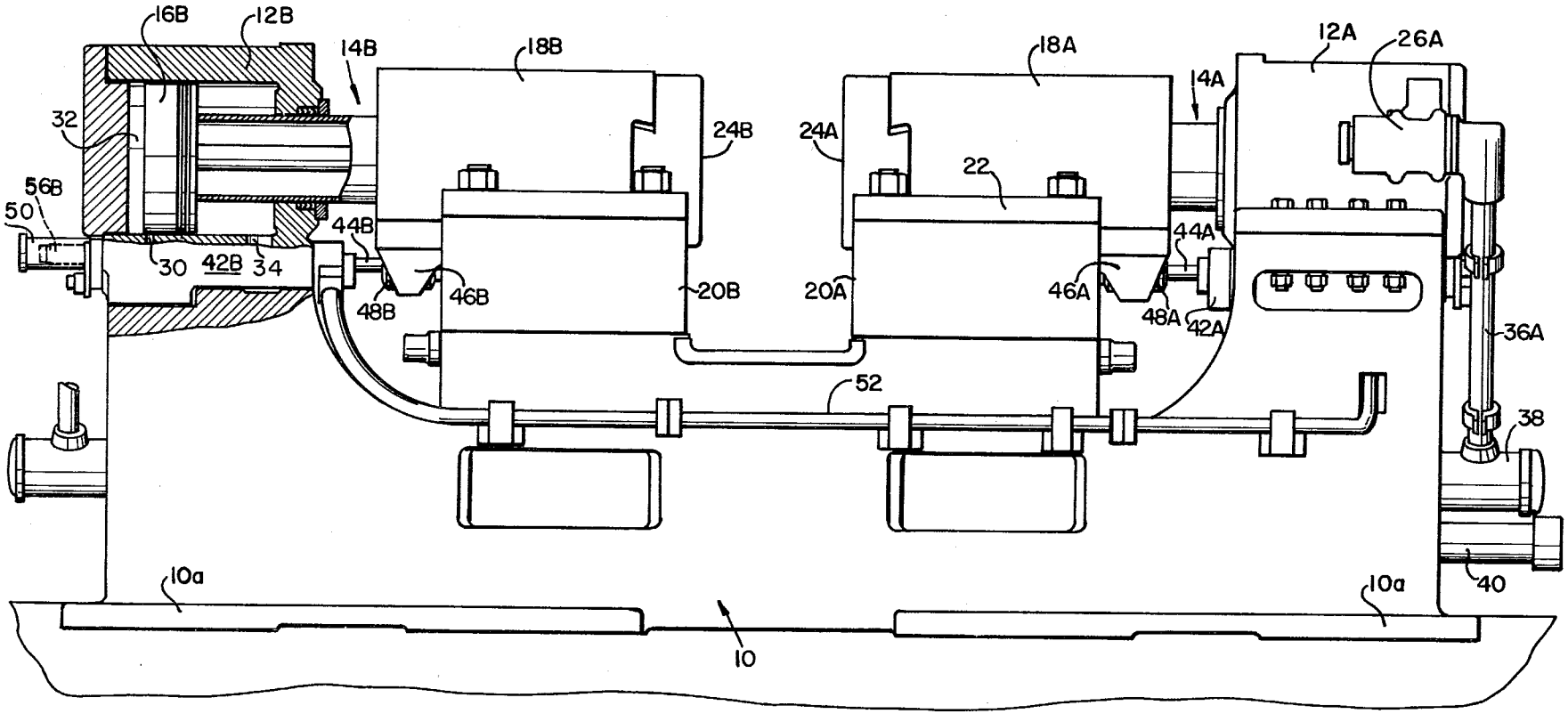
FIG. 1 is a side view of a counter-blow type of impact forging hammer having features in accordance with the present invention, having part of the structure broken away to reveal internal parts shown in section.
Figure 2:
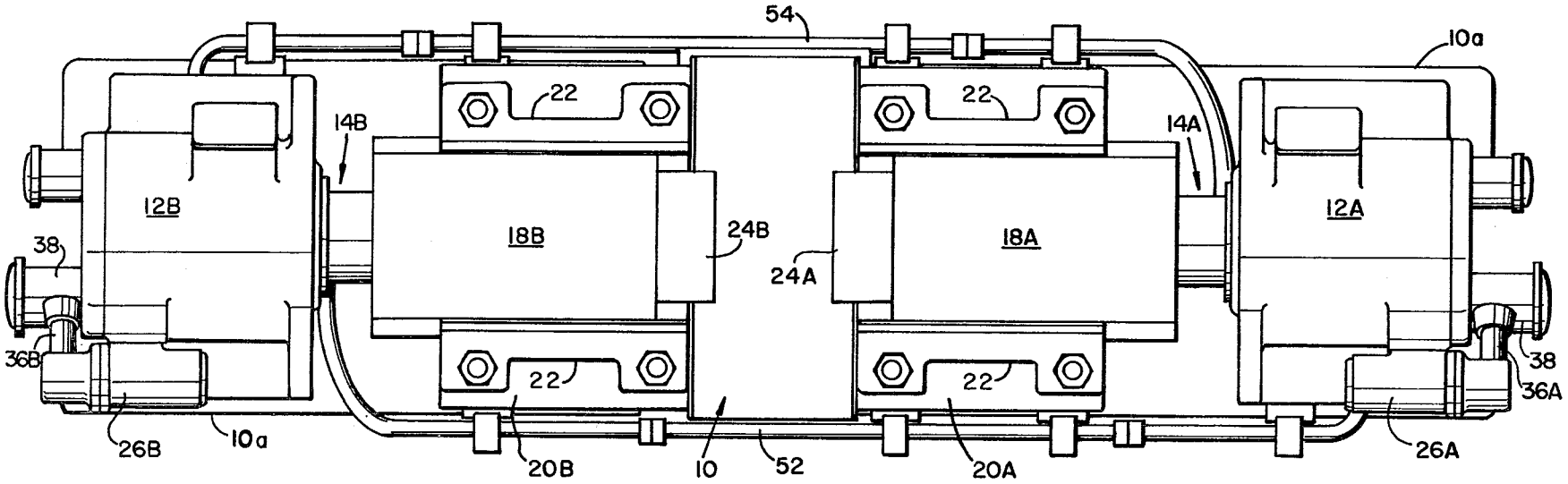
FIG. 2 is a plan view from above of the machine of FIG. 1.
Figure 3:
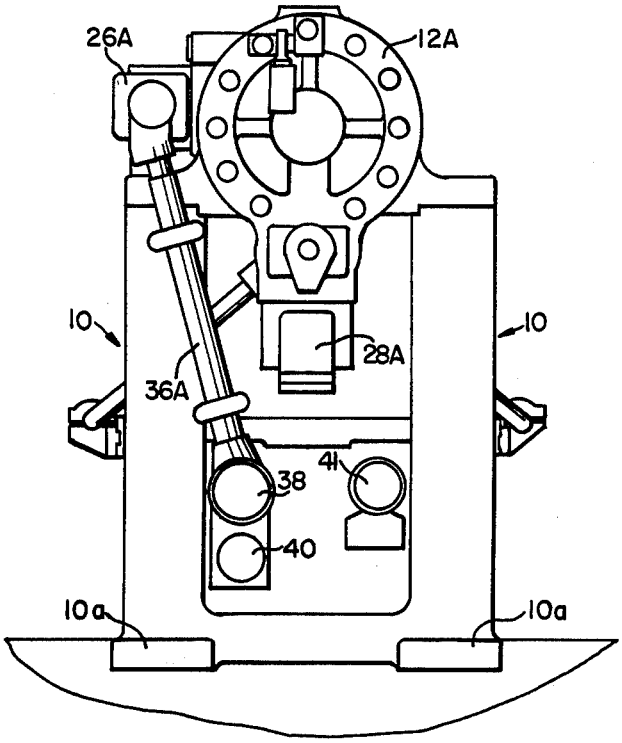
FIG. 3 is an end view of the machine of FIG. 1 and FIG. 2.
Figure 6:
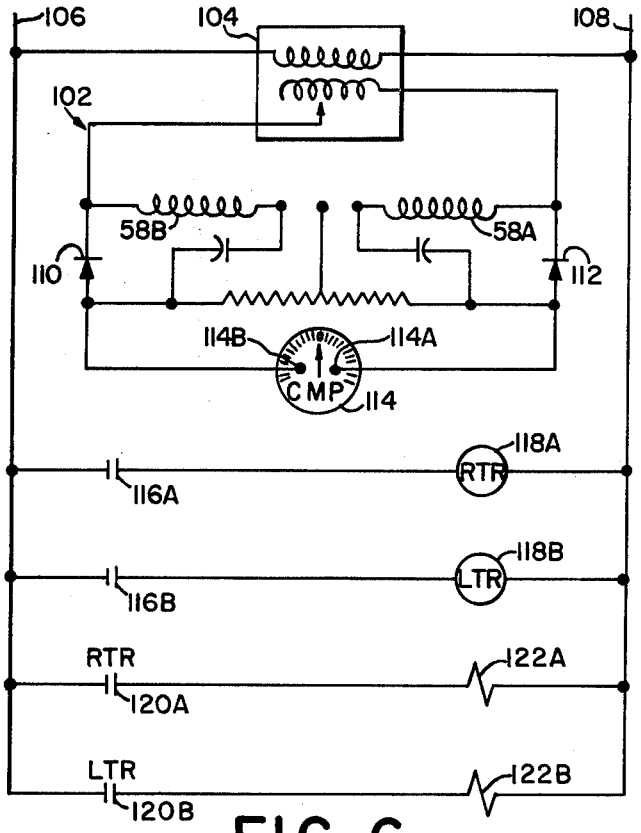
FIG. 6 is a circut diagram showing electrical elements of the pneumatic correction system.

Referring first to FIGS. 1, 2 and 3, the counter-blow type of impact forging hammer shown comprises a support frame, generally designated 10, comprised of large ferrous castings. The support frame preferably has foot flanges 10*a* which are bolted to the ground, and preferably embedded in the floor. Supported on the support frame 10 are a pair of identical horizontally aligned oppositely directed and spaced apart drive cylinders 12A and 12B. As will appear thereafter, these are pneumatic cylinders designed to accommodate driving air pressure (or pressure derived from other highly compressible gaseous fluids). Pistons 16A and 16B are snuggly engaged within the cylinders 12A and 12B, respectively, in a conventional manner well-known in the art. Connection means 14A and 14B, for example, of the columnar construction covered in U.S. Pat. No. 3,080,778 to R. L. Alcorn, Jr., connect the pistons 16A and 16B to the impellers 18A and 18B. The structure of piston connection and impeller is sometimes referred to as a "ram". Each of the impellers 18A and 18B is supported on a separate support structure 20A and 20B, respectively. Support structures 20A and 20B are those parts of the frame 10 which provide ways for guiding and directing the impellers 18A and 18B in their aligned paths toward and away from one another. The flanges on the impellers are held within the ways by cover plates 22 on each side of the impellers by bolts firmly affixing the plates to the impeller supports 20A and 20B. The impellers provide means for retraction attachment of dies 24A and 24B, which are selected for the particular work to be forged. The guiding structures and ram head engagement of the dies are conventional and well-known. However, particularly in these areas, frictional differences, lubrication differences and other factors relating to variations in the movement of one impeller with respect to the other cause variations in ram response causing the impellers to move out of synchronism. Other factors producing variations have to do with frictional effects between the piston and cylinder or the seals.

Movement of the ram structures is accomplished by force of air pressure upon the pistons 16A and 16B. Controlled Introduction of air into the cylinders behind the pistons 16A and 16B drive the impellers 18A and 18B toward each other. As seen in FIGS. 1 and 2 each of the cylinders is provided with a main inlet valve 26A and 26B. Each valve has conventional and well-known controls of types, for example, shown in the aformentioned patent, but at only the outer end of each cylinder in this case, to enable a shift of the control element to cut off the flow of air or to direct flow to the outward side of the piston to drive it forward. A large passage is needed to provide full force of the air into the drive cylinder 12A or 12B to drive the respective pistons 16A and 16B toward one another. Amount of force is not so important and is generally less in retracting the piston, but equal force to keep the rams in synchronism is important. Exhaust valves 28A and 28B, also only at the outer end of each cylinder, enable exhausting of air from the respective cylinders behind each piston as volume is reduced up to the point of the exhaust duct 30. Valve 28A seen in FIG. 3, and valve 28B in the corresponding position at the other end of the machine, constitute control means regulating the exhaust fluid from each drive cylinder through the exhaust port to permit each drive piston or its associated impeller to be withdrawn from impact. Each such valve is entirely conventional and, for example, may be of the general type of valve shown in FIG. 2 of U.S. Pat. No. 2,636,350 to Alcorn, Jr., and assigned to the assignee of this invention. At that point the piston closes off the exhaust duct 30 and, when the inlet valve is closed, the air in the limited air space 32 at the end of the cylinder remote from the impeller provides a cushion of air behind the piston. Additional air may be introduced into this limited air space as will be explained hereafter for the purpose of drive piston position correction. However, normally having air is introduced at the end wall of the cylinder by valve 26 from a large duct (not shown). The rod end of the cylinder is in constant communication with a source of regulated low pressure air through port 34 as seen in FIG. 1. Each of the inlet valves 26A and 26B is fed air by suitable inlet duct work 36A and 36B connected to opposite ends of a header 38. Air is fed to the midpoint of header 38 from the air supply through inlet duct 40.

Just as variations in hammer constructions are unimportant to the present invention, the actual operation of the hammer is not of great significance. Various structures and various modes of operation are explained in various prior patents mentioned above. Suffice it to say that every effort is taken to see that the piston 16A and 16B are subjected to the same force of air at the same time and start from the same positions so that, other factors being equal, the impeller dies will meet at midpoint. The main inlet valves are synchronized and the exhaust valves are coordinated and synchronized with one another. Timing of valve operation determines the force applied and it is important that the driving forces on each piston be the same. A source of low pressure air is constantly applied to each return air port 34 to return the rams to retracted position. The air is supplied to the rod end of both cylinders at the same low pressure all of the time. Therefore, when the exhaust valves are open at the same time, both cylinders experience the same pattern of return pressure and rate of exhaust of the air from the remote side of the piston. Although these efforts may become highly sophisticated and must be carefully controlled, differences in variable factors may be introduced with regard to each of the impellers. Very small differences which creep into the air and exhaust systems together with variable problems that have to do with friction and lubrications both with regard to the pistons within the cylinders and the impellers in their ways, may destroy the synchronous movement of the impellers. These factors can also vary from time to time so that what is true at one time may not be true at another. In addition, the effects are very difficult to predict or to detect when present. However, ram position relative to the frame is something which can always be detected and has been detected in the prior art in connection with various types of control correction. Position sensing of various positions along the path of ram travel is also used in accordance with the present invention.

Figure 4:
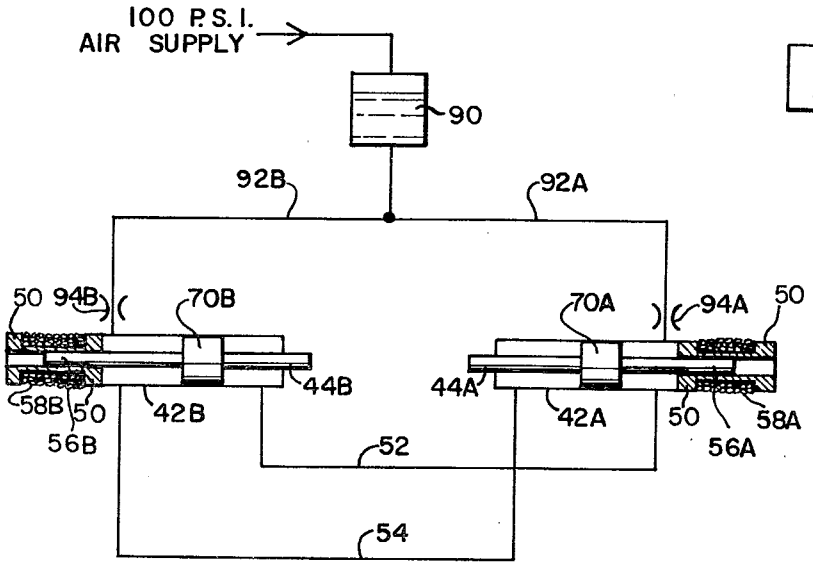
FIG. 4 is a shcematic diagram representing the incompressible fluid stabilizing system of the present invention.

Referring again in particular to FIG. 1, it will be seen that an additional smaller stabilizing cylinder 42A and 42B is provided beneath and parallel to each of the air cylinders 12A and 12B. Within each stabilizing cylinder, as seen in FIG. 4, is a snuggly accommodated piston 70A and 70B which is provided with a double ended piston rod. The piston rods forward end 44A and 44B, respectively, are attached to flanges 46A and 46B by suitable coupling flanges 48A and 48B, respectively. The other piston rod 56A and 56B extends out the other end of the stabilizing cylinder away from the impellers and have functions which will be explained hereafter in greater detail. A hydraulic line 52 connects the front end of cylinder 42B to the back end of cylinder 42A. As seen in FIG. 2 (and also in schematic FIG. 4), a similar line 54 connects the front end of cylinder 42A to the back end of cylinder 42B. Also as seen in FIG. 1 the back end of cylinder 42B may carry a non-magnetic generally cylindrical spool 50 which supports an electrical coil 58, the function of which will be described later.

Referring now to FIG. 4, the function of the structure of stabilizing cylinders 42A and 42B which is shown in cross-section, and its piston 70 are illustrated. The stabilizing cylinders are simply double rod end cylinders with piston rings sealing the piston and Chevron type rod seals, all of which is well known in the art. The remote ends of each of the stabilizing cylinders 42A and 42B are each conncted by fluid lines 92A and 92B through orifices 94A and 94B, respectively, to a fluid reservoir 90. The fluid reservoir 90 is pressurized with 100 PSI air pressure which statically pressurizes the entire hydraulic system. This positive pressure functions to keep air out of the system. The orifices which are typically about 1/32 inch diameter are relatively small compared to the annular cylinder area (typically $2\frac{1}{4}$ diameter bore $\times 1\frac{1}{4}$ diameter rod). Hence, the orifices allow minute flow of oil into or out of the cylinder as the closed volume of oil within the system expands or contracts due to temperature changes. However, during the course of a single blow not enough fluid can flow through the orifice to significantly affect the relative position of the impellers. Thus, the orifices function to permit long term pressure adjustment without affecting the dynamic performance of the system.

Figure 5:
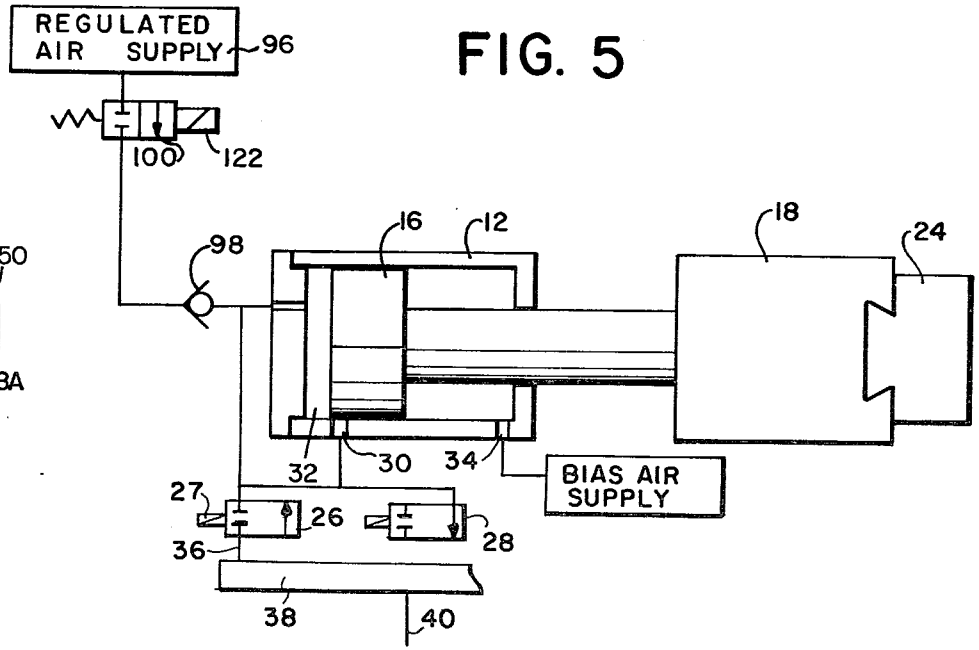
FIG. 5 is a schematic drawing showing part of the pneumatic correction system for adding air to the cushion of one of the drive cylinders.

In the diagram of FIG. 5 the drive cylinder 12 and enclosed drive piston 16 is represented quite schematically, as are other parts of the structure shown in FIG. 1. FIG. 5 is intended to illustrate, however, in somewhat exaggerated form, the region of the air cushion 32 in the rear of the drive cylinder 12. The region is defined and the cushion created when the exhaust port 30 is closed off by the piston 16 in the course of its retraction. This cusion serves as a means for slowing, and terminating the retraction movement of the ram structure, and ultimately repositioning it forward toward impact. Also shown schematically is a supply of low pressure bias air introduced through a forward port 34 into cylinder 12 to return piston 16 to its retracted position. The drive air pressure common supply line 40, header 38, cylinder supply line 36, control valve 26, and control means 27 are shown connected to the cushion port and main port 30. Exhaust valve 28 and its control means 29 are also shown connected to port 30.

After each impact blow the impellers are retracted or returned toward the back of stroke by air pressure acting at the impeller end of the drive piston. In this process the back or drive end of the drive cylinder 12 is open to the atmosphere through exhaust port 30 and through the open exhaust valve 28. When the piston covers the exhaust port 30, as shown, a pneumatic cushion is developed in that portion of the cylinder to the rear of the exhaust port. As the piston enters the cushion, pneumatic pressure increases to provide ram opposing force that retards the motion of the impeller. The geometry of the cushion is such that the retarding force builds at a very fast rate and the magnitude of the force is proportional to the distance through which the piston has entered into the cushion. Consequently, if one piston enters a cushion before the other piston, the leading piston will undergo a retarding force sooner and it will be large since the leading piston will enter the cusion farther. Hence, the pistons are urged to become more nearly synchronized following each and every impact blow.

Whenever the impacter strikes repeated blows, that is, when succeeding blows are initiated as soon as the impellers are returned, the system as described promotes "on-center" blows. However, if the forging program is such that the impellers are at rest between blows, one or both impellers may tend to move slowly (creep) back into the cylinder cushion area as the result of hydraulic leaks or other conditions promoting unbalance. If and when this happens, and the drive pistons start from different positions, off-center blows will result.

To overcome this condition a pressure regulated source 96 of make-up cushion air is furnished and applied by means of an automatic sensing control system. The source of regulated air is connected to each cylinder through a check valve 98, which prevents flow out of the cylinder. The supply to the drive cylinder is controlled by a valve, preferably a straight-way, normally closed, solenoid operated valve 100. The solenoid valves are controlled by a regulating circuit responding to an automatic sensing means as described below.

As seen in FIG. 4 an inductance coil 58A and 58B is positioned to surround the rearwardly extending piston rods 56A and 56B in their impeller retracted positions. The coils 58A and 58B, or similar sensing means, may be employed in a circuit, such as shown in FIG. 4. In FIG. 4, the coils 58B and 58A are connected in meter circuit 102 which derives power from a variable transformer 104 across power lines 106 and 108. The coils are series connected across the secondary of transformer 104 and across a meter relay (CMR) 114 through diodes 110 and 112. When the induced voltage from one coil, e.g., 58A is greater than the other, e.g., 58B the meter will deflect to reflect such unbalances. Adjustable contacts 114A and 114B on the meter are arranged so that whenever the voltage difference exceeds a preset level, contacts 116A and 116B, providing a right centering meter relay or left centering meter relay will close. Contacts 116A are in series with right relay timer 118A and contacts 116B in series with left relay timer 118B. These timers, when energized, close contacts (RTR) 120A or (LTR) 120B for a short time duration which energized either the right or left cushion control solenoid valve, 112A and 122B, respectively, to allow an increment of air to be supplied to the cushion in the appropriate cylinder.

Hence, if one of the main pistons creeps further back into the cylinder cushion than the other, the sensing coils 58A and 58B, meter 114, the appropriate relay 116A and 116B and the responding timer 118A and 118B, will cause the proper valve to admit that increment of make-up cushion air permitted by the timer setting, thereby respositioning the associated piston forward toward impact. It is possible that several increments may be admitted in succession.

It will be clear that transducer means other than inductance coils 58A and 58B may be used to sense positions. Other control circuits may be used with the inductive coils or with other types of transducers. For example, other differential sensing means than the contact meter and different types of relays may be used. Instead of timing means, to meter the increments passed by the valves, other incremental flow regulating devices or proportion means might be used. Furthermore, it is possible that the sensing means, transducers and various circuits disclosed herein might be used with another type of position adjusting techniques for counter-blow hammers.

The above described embodiments of the present invention are, of course, subject to many other modifications which will occur to those skilled in the art, and are intended to be merely representative of the possible embodiments of the present invention. All embodiments within the scope of the claims are intended to be within the scope and spirit of the present invention.

We claim:

1. In a counter-blow type of impact forging hammer having a common support frame, a pair of impellers, means supporting, driving and guiding said impellers along predetermined aligned paths to impact, including a pair of drive pistons and connection means connecting each piston to one of the impellers and a pair of opposed aligned drive cylinders supported on said support frame and each having inlet and exhaust ports in the same end of each of said drive cylinders positioned to permit drive of the pistons by compressible fluid, high pressure compressible fluid supply means and conduit means connecting the compressible fluid supply to an inlet port of each of the drive cylinders, impact force regulating valve and control means for the respective conduit means controlling the flow of the compressible fluid into the drive cylinders, additional control means regulating the exhaust fluid from each drive cylinder through the exhaust port to permit the drive piston and its associated impeller to be withdrawn from impact, a relatively lower pressure fluid bias supply to another port in the opposite end from the inlet and exhaust ports, an improved synchronizing system comprising:

a pair of stabilizing cylinders supported on the support frame generally parallel to the drive cylinders, stabilizing piston means within the stabilizing cylinders, a connection between each stabilizing piston and some part of the moving structure attached to the impeller, fluid flow lines cross-connected between said stabilizing cylinders, including a connection between the near-impeller end of each stabilizing cylinder and the remote end of the other stabilizing cylinder, and imcompressible fluid within an essentially filling the stabilizing cylinders and cross-connected lines whereby the fluid within the stabilizing cylinders will tend to resist any tendency for one piston and its connected impeller to move ahead of the other.

2. The counter blow impact hammer of claim 1 in which a supply of incompressible fluid is fed into the stabilizing cylinders through means maintaining pressure at the desired level.

3. The counter blow impact hammer of claim 2 in which regulator means is provided to maintain the pressure of the incompressible fluid to be fed into the stabilizing cylinders at a predetermined level and flow and pressure is controllwed by passing the fluid through similar orifices before entering the stabilizing cylinders.

4. The counter blow impact hammer of claim 1 in which the incompressible fluid is a material fluid is a material providing self-lubricating qualities.

5. The counter blow impact hammer of claim 1 in which each of the drive cylinders is provided with an air cushion area at the end remote from the impellers which effectively retards the ram movement in the course of retraction and causes positioning of the piston in the cylinder preliminary to the next stroke, a regulated pressure air supply is connected to the cushion area of each drive cylinder, and control valve means provided between said cushion and said regulated pressure air supply.

6. The counter blow impact hammer of claim 5 in which a check valve is also provided in said line between said cushion and said regulated air supply in such direction as to prevent the escape of air from the cushion area.

7. The counter blow impact hammer of claim 6 in which the control valve is operated in response to sensing means sensing relative drive ram positions.

8. The counter blow impact hammer of claim 6 in which sensing means are arranged to sense the positions of the respective stabilizing pistons and are arranged in a differential system which detects an imbalance in position and acts to correct that imbalance by operating that control valve means which controls air to the drive cylinder whose piston needs adjustment.

9. The counter blow impact hammer of claim 8 in which each sensing means is a transducer which modifies an electrical parameter.

10. A counter-blow type impact forging hammer in accordance with claim 9 wherein said transducer means providing variable electrical parameters are associated with each synchronizing piston to detect piston positions, and the electrical variable transducer elements are included in a circuit permitting detection of differential values and actuation of correction means associated with the control valves to the regulated air supply permitting incremental introduction of air into that cushion of the drive piston whose position requires advance.

11. The counter-blow type impact forging hammer of claim 10 in which the variable electrical transducer is a coil in fixed position whose inductance is varied as the position of the stabilizing piston changes by a magnetic core which is attached to structure moving with the stabilizing piston.

12. The counter-blow type impact forging hammer of claim 11 in which the winding of the transducer is supported on the end of the stabilizing cylinder remote from the impeller and the core of the transducer is the end of a piston rod attached to the piston and extending away from the impeler and out the end of the stabilizing cylinder.

13. The counter-blow type impact forging hammer of claim 11 in which the differential signal detected by differences in inductance actuates switch means to select the one of two relays, in turn, actuating the selected control valve for the air supply to the cushion.

14. The counter-blow type impact forging hammer of claim 13 in which each of two relays including a timing relay and the control valve employs a solenoid actuator so that for the period timed by the timing relay and solenoid actuator keeps the control valve open.

15. In a counter-blow type of impact forging hammer having a common support frame, a pair of impellers, means supporting, driving and guiding said impellers along predetermined aligned paths to impact, including a pair of drive pistons and connection means connecting each piston to one of the impellers and a pair of opposed aligned drive cylinders supported on said support frame and each having inlet and exhaust ports in the same end of each of said drive cylinders positioned to permit drive of the pistons by compressible fluid, high pressure fluid supply means and conduit means connecting the compressible fluid supply to an inlet port of each of the drive cylinders, impact force regulating valve and control means for the respective conduit means controlling the flow of the compressible fluid into the drive cylinders, additional control means regulating the exhaust fluids from each drive cylinder through the exhaust port to permit the drive piston and its associated impeller to be withdrawn from impact, a relatively lower pressure fluid bias supply to another part in the opposite end of the inlet and exhaust ports, and an improved position correction system in which the port to the exhaust valve is located in each drive cylinder forward of the rearmost retraction position of the piston such that in the courst of retraction movement the piston closes off the exhaust port to create and maintain an air cushion with the drive cylinder against which the drive piston moves as the ram is retracted past the exhaust port and in which the air cushion in each drive cylinder may be augmented from a regulated air supply of compressed air through separate regulating valves and a timer controlled solenoid to operate each said regulating valve.

16. The counter-blow type impact forging hammer of claim 15 in which each regulating valve is timer actuated by a timer mechanism for a predetermined time to allow an increment of air fixed by said timer to enter the air cushion.

17. The counter-blow type impact forging hammer of claim 15 in which position imbalance is detected by transducers associated with said system, a part of each transducer being movable with the respective impeller to provide a variable electrical signal circuit including said transducers electrical parameters actuating one of the control means for valves permitting an incremental flow of air from said regulated air supply into the cushion of that drive cylinder requiring more pressure to restore balance.

18. In a counter-blow type of impact forging hammer having a common support frame, a pair of impellers, means supporting, driving and guiding said impellers along predetermined aligned paths to impact, including a pair of drive pistons and connection means connecting each piston to one of the impellers and a pair of opposed aligned drive cylinders supported on said support frame and each having inlet and exhaust ports positioned to permit drive of the pistons by compressible fluid, high pressure compressible fluid supply means and conduit means connecting the compressible fluid supply to an inlet port of each of the drive cylinders, impact force regulating valve and control means for the respective conduit means controlling the flow of the compressible fluid into the drive cylinders, control means regulating the exhaust fluid from each drive cylinder through the exhaust port to permit the drive piston and its associated impeller to be withdrawn from impact, correction means to reposition the drive piston in the drive cylinder, control means for controlling the adjustment of the drive piston, and differential sensing means to detect relative position differences in the structure movable with the respective impellers.

19. The counter-blow type impact forging hammer of claim 18 in which the sensing means are transducers having variable electrical elements to represent differences in positions of the impellers and act upon correction means to correct the position of at least one drive piston in its drive cylinder relative the other drive piston.

20. The counter-blow type impact forging hammer of claim 19 in which correction is performed through an adjustment to one of the pistons only.

21. The counter-blow type impact forging hammer of claim 20 in which the correction is an incremental one.

* * * * *

UNITED STATES PATENT AND TRADEMARK OFFICE

CERTIFICATE OF CORRECTION

PATENT NO. : 4,245,492

DATED : January 20, 1981

INVENTOR(S) : Eugene C. Clarke, Jr. and Charles W. Frame

It is certified that error appears in the above-identified patent and that said Letters Patent are hereby corrected as shown below:

Column 1, lines 11 and 29, "forgoing" should be --forging--;
line 17, "stabilizing" should be --synchronizing--;
line 18, "synchronizing" should be --stabilizing--;
line 46, after "years" the period (.) should be a comma (,);
line 57, "raws" should be --rams--;
lines 58-59, "modification" should be --modifications--;
line 60, "crases" should be --cases--.

Column 2, line 14, "imcompressible" should be --incompressible--;
line 17, "conections" should be --connections--.

Column 3, line 15, "reset" should be --rest--;
line 47, "shcematic" should be --schematic--;
line 53, "circut" should be --circuit--;
line 66, "thereafter" should be --hereafter--.

Column 4, line 67, "having" should be --driving--.

Column 6, line 6, "conncted" should be --connected--.

UNITED STATES PATENT AND TRADEMARK OFFICE

CERTIFICATE OF CORRECTION

PATENT NO. : 4,245,492

DATED : January 20, 1981

INVENTOR(S) : Eugene C. Clarke, Jr. and Charles W. Frame

It is certified that error appears in the above-identified patent and that said Letters Patent are hereby corrected as shown below:

Claim 3, line 5, "controllwed" should be --controlled--.
Claim 4, lines 2 and 3, after "material" (first occurrence) delete "fluid is a material".
Claim 15, line 30, "courst" should be --course--.

Signed and Sealed this

*Twenty-first* Day of *April 1981*

[SEAL]

*Attest:*

RENE D. TEGTMEYER

*Attesting Officer*

*Acting Commissioner of Patents and Trademarks*